United States Patent [19]

Usui et al.

[11] 4,204,180

[45] May 20, 1980

[54] END OF PAPER ROLL DETECTION ASSEMBLY

[75] Inventors: Kiyofumi Usui; Chihiro Otsuki; Sadaharu Inukai, all of Shiojiri, Japan

[73] Assignees: Kabushiki Kaisha Suwa Seikosha; Shinshu Seiki Kabushiki Kaisha, both of Tokyo, Japan

[21] Appl. No.: 889,673

[22] Filed: Mar. 24, 1978

[30] Foreign Application Priority Data

Mar. 24, 1977 [JP] Japan ..... 52-35786

[51] Int. Cl.[2] ..... H01H 9/00; G08B 21/00; B65H 25/00

[52] U.S. Cl. ..... 335/205; 226/11; 242/57; 340/675

[58] Field of Search ..... 335/205; 242/57; 340/675; 226/11

[56] References Cited

U.S. PATENT DOCUMENTS

| | | | |
|---|---|---|---|
| 3,123,268 | 3/1964 | Gagg | 226/11 X |
| 3,286,249 | 11/1966 | D'Angelo | 340/675 |
| 3,800,254 | 3/1974 | Beery | 335/205 |
| 3,908,810 | 9/1975 | Denley | 197/133 R |
| 3,938,119 | 2/1976 | Schwartz | 226/11 X |

*Primary Examiner*—Fred L. Braun

*Attorney, Agent, or Firm*—Blum, Kaplan, Friedman, Silberman & Beran

[57] ABSTRACT

An end of paper roll detection assembly for detecting the end or near-end of a paper roll on a hollow core is provided. The end of paper roll detection assembly includes a detecting bar pivotally mounted on a retaining bar biased towards the side face of the paper roll which is supported on an adjustable paper roll retaining member. When paper is consumed the core is lowered towards the retaining member until the core is aligned with the detecting bar which passes into the hollow core thereby actuating a switch for generating a signal indicating that a predetermined amount of paper remains on the roll. The switch may be a reed switch closed by a permanent magnet secured to the retaining bar or a microswitch operated by the retaining bar. The retaining bar pivots towards the paper roll by action of a pulsating electro-magnet or a spring biasing the retaining bar towards the paper roll.

13 Claims, 6 Drawing Figures

END OF PAPER ROLL DETECTION ASSEMBLY

BACKGROUND OF THE INVENTION

This invention relates generally to an end of paper roll detection assembly, and particularly to an end of paper roll detection assembly which automatically signals the approaching end of a paper roll in a printer, or the like. Conventionally there have been many types of paper roll end detecting devices which indicate a small amount of remaining paper on a paper roll. Approaching near-end of the paper roll is most often detected visually by providing a red or blue color on the paper at the end of the roll. However, such visual detection causes problems many times because the operator inadvertently continues the printing operation without acknowledging that the near-end of the paper roll condition exists. Alternatively, means may be provided for keeping the end of the paper roll attached to its core with glue, or the like for applying tension to the paper roll immediately before the paper is fully wound. This provides more adequate detection of the end of the roll, however, this method presents many defects in that the paper roll cannot be inserted easily and replacing the paper roll cannot be performed smoothly. This latter problem arises due to insufficient allowance of remaining paper which may cause maloperation due to external factors. Accordingly, it is desirable to provide an automatic end of paper roll detection assembly which overcomes the defects of conventional detection means.

SUMMARY OF THE INVENTION

Generally speaking, in accordance with the invention, an end of paper roll detection assembly for detecting the end or near-end of a paper roll wound on a hollow core is provided. The end of paper roll detection assembly actuates a switch when a predetermined amount of paper remains on the roll. The detection assembly includes a frame formed with an opening and an adjustable paper roll retaining member. As paper is consumed, the hollow core is lowered towards the retaining member and opening. A retaining bar is pivotally mounted on the frame and the detecting bar is pivotally mounted on the retaining bar and is inserted through the frame opening. The retaining bar is biased towards the frame opening and paper roll to intercept the side face of the paper roll when more than the predetermined amount of paper remains on the roll. Upon reduction in amount of paper remaining on the roll the core is aligned with the frame opening and the detection bar is inserted into the hollow core and a switch is tripped by movement of the retaining bar.

The switch is a reed switch mounted on the paper roll frame and a permanent magnet for actuating the reed switch is mounted at the free end of the retaining bar. Alternatively, a microswitch may be tripped by the displacement of the retaining bar upon reaching the predetermined near-end amount of paper. The retaining arm is biased towards the paper roll by an electromagnet subassembly for the intermittent displacement of the retaining bar and detection bar towards the paper roll so that the detecting bar is inserted into the paper core as soon as a predetermined amount of paper remains on the roll. In another embodiment of the invention the retaining bar is pivotally mounted on the paper roll frame and biased towards the paper roll by a spring so that the detecting bar contacts the side face of the paper roll until it is displaced into the hollow core.

Accordingly, it is an object of the invention to provide an improved end of paper roll detection assembly.

Another object of the invention is to provide an improved end of paper roll detection assembly which automatically trips a switch to provide a signal when a predetermined amount of paper remains on the roll.

A further object of the invention is to provide an improved end of paper roll detection assembly of high accuracy which does not interfere with conventional operability.

Still another object of the invention is to provide a low-priced end of paper roll detection assembly wherein the predetermined amount of paper remaining is adjustable.

Still a further object of the invention is to provide an improved end of paper roll detection assembly resistant to printer vibration.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
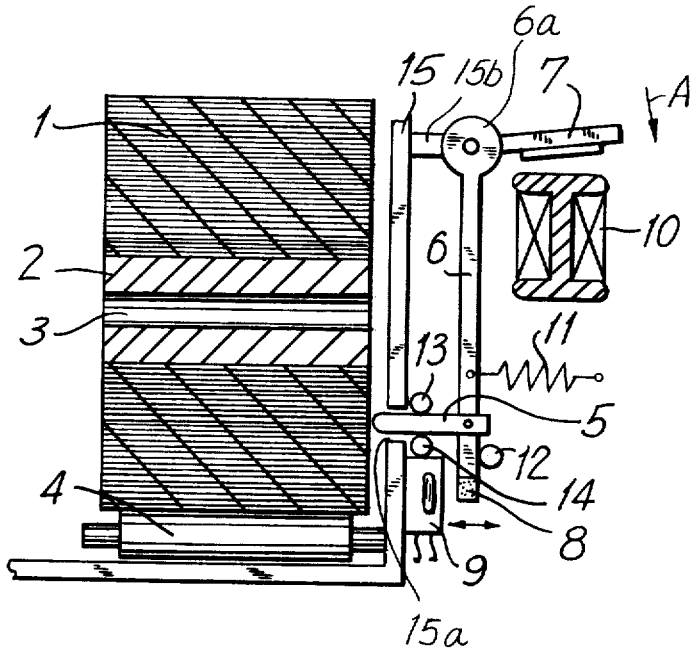
FIG. 1 is a side elevational view of an end of paper roll detection assembly, with a paper roll shown in cross-section, constructed and arranged in accordance with an embodiment of the invention.

Referring now to FIG. 1, an end of paper roll detection assembly constructed and arranged in accordance with one embodiment of the invention is shown. A roll of paper 1 wound on a core 2 having a center hollow portion 3 is positioned on a paper roll retaining member 4 adjustably mounted on a frame 15. Frame 15 is formed with an opening 15*a* positioned to be aligned with hollow portion 3 of paper roll core 2 when paper roll 1 approaches near-end and hollow portion 3 is lowered to retaining member 4. Retaining member 4 may be positioned at a variable distance from opening 15*a* to vary the amount of paper 1 remaining on core 2 when hollow portion 3 is aligned with opening 15*a*.

An elongated retaining bar 6 formed with a mounting portion 6*a* is pivotally mounted on a frame arm 15*b* to allow retaining bar 6 to overlap opening 15*a*. A detecting bar 5 is pivotally mounted on retaining bar 6 to pass through opening 15a. When hollow portion 3 is aligned with opening 15a at near-end, detecting bar 5 may be displaced into hollow portion 3.

A metallic attracting plate 7 is mounted to mounting portion 6a of retaining bar 6 and an electromagnet 10 is positioned for selectively attracting bar 7 thereto when actuated for pivoting retaining bar 6 to a position towards paper roll 1. Retaining bar 6 is biased in a first at rest position away from paper roll 1 against a stopper 12 by a spring 11. When electromagnet 10 is energized, an attracting plate 7 is displaced towards electromagnet 10, retaining bar 6 is pivoted to its second position towards paper roll 1 and detecting bar 5 is displaced towards its second position between a pair of pins 13 and 14. When paper roll 1 is at near-end, detecting bar 5 enters hollow portion 3 of paper roll core 2.

Retaining bar 6 is also formed with a permanent magnet 8 at its free end and a reed switch 9 is mounted on paper roll frame 15. Reed switch 9 is positioned on frame 15 to be closed by permanent magnet 8 when detecting bar 5 is displaced to its second position in hollow portion 3 by actuation of electromagnet 10.

FIG. 1 illustrates the position of retaining bar 6 when a large amount of paper 1 remains on core 2 and electromagnet 10 is not energized. A pulsating current B is applied to electromagnet 10 when the paper roll is not unwinding and attracting plate 7 is pivoted towards electromagnet 10 as indicated by an arrow A. Retaining bar 6 is pivoted towards paper roll 1 and detecting bar 5 is displaced towards paper roll 1 and impinges the side face of paper roll 1. Thus, retaining bar 6 cannot be displaced to its second position and permanent magnet 8 mounted thereon and reed switch 9 remains in its OFF condition which indicates that paper roll 1 is not at its near-end condition. Even if pulses are continuously applied to electromagnet 10 when paper roll 1 is in the condition illustrated in FIG. 1, the near-end state of paper roll 1 will not be detected.

Figure 2:
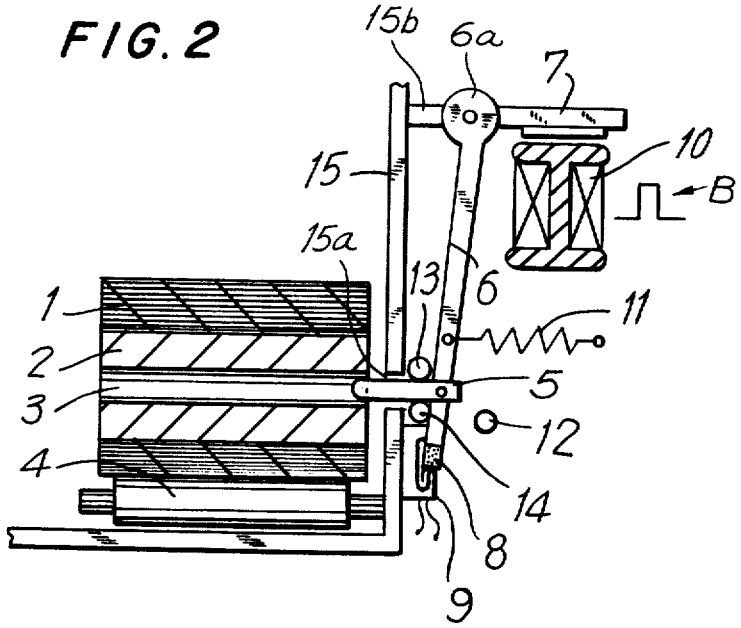
FIG. 2 is a side elevational view of the assembly illustrated in FIG. 1 as the paper roll approaches near-end.

Referring now to FIG. 2, as the diameter of paper roll 1 is gradually reduced and reaches the condition shown, the electrical pulses to electromagnet 10 of a predetermined timing causes detecting bar 5 to be displaced into hollow portion 3 of core 2 as detecting bar 5 no longer impinges against the side face of paper roll 1. At this time retaining bar 6 is pivoted to its second position against pin 14 and permanent magnet 8 operates reed switch 9. As reed switch 9 is placed in its ON condition, a signal is provided by a paper near-end detection circuit (not shown) which will indicate that paper roll 1 has approached its near-end condition. Timing pulses may be applied to electrical magnet 10 in any predetermined pattern such as is shown by pulse B, or continuously when paper roll 1 is unwinding or at rest.

In accordance with the invention, the near-end detection signal provided by actuation of reed switch 9 may be varied to indicate differing amounts of paper 1 remaining on core 2. This adjustable feature is provided by moving retaining member 4 upwardly or downwardly within frame 15 relative to opening 15a. For example, to obtain a near-end detection signal as early as possible, retaining member 4 is positioned away from opening 15a. On the other hand, in order to obtain a near-end condition signal as late as possible with a lesser amount of paper 1 remaining on core 2, retaining member 4 is positioned upwardly closer to opening 15a.

Figure 3:
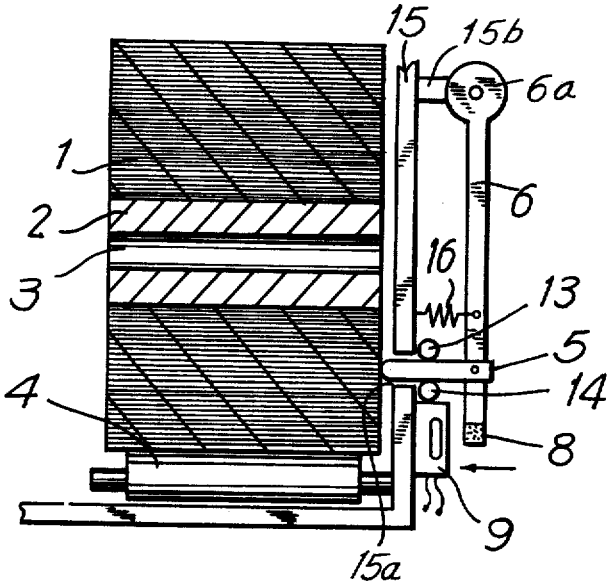
FIG. 3 is a side elevational view of an end of paper roll detection assembly, with a paper roll shown in cross-section, constructed and arranged in accordance with another embodiment of the invention.
Figure 4:
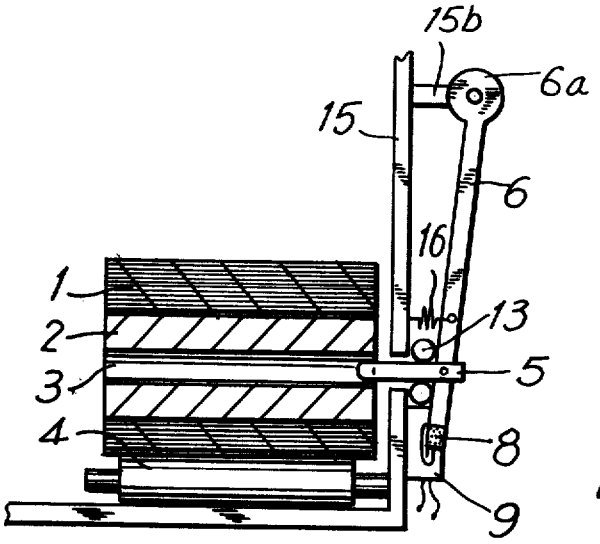
FIG. 4 is a side elevational view of the assembly illustrated in FIG. 3 at near-end of paper roll.

A second embodiment of a near-end of paper roll detection assembly constructed and arranged in accordance with the invention is illustrated in FIGS. 3 and 4. Like elements performing similar functions in FIGS. 3 and 4 are indicated by like reference numerals with respect to the embodiment illustrated in FIGS. 1 and 2. A detailed description of these elements having the same reference numerals will not be set forth.

Referring specifically to FIG. 3, the condition of the paper roll near-end detecting assembly with a large amount of paper 1 remaining on core 2 is illustrated. In this embodiment, retaining bar 6 is biased towards paper roll 1 by a spring 16 mounted between retaining bar 6 and paper roll frame 15. This continual biasing of retaining bar 6 towards paper roll 1 causes detectiing bar 5 to impinge continuously against the side face of paper roll 1 as paper roll 1 is unwound during printing.

Referring now to FIG. 3, as paper 1 on core 2 approaches its near-end condition, detecting bar 5 is displaced to its second position in hollow portion 3 of core 2 by the biasing force provided on retaining bar 6 by spring 16. As retaining bar 6 is displaced to its innermost position against pin 14, permanent magnet 8 passes over reed switch 9 thereby indicating an ON condition. The ON condition of reed switch 9 actuates the near-end detection circuit which signals the near-end of paper 1. As described with respect to the embodiment shown in FIGS. 1 and 2, the ON condition of reed switch 9 and the corresponding near-end signal can be obtained at a time when a predetermined amount of paper 1 remains on core 2. This is varied by displacing retaining member 4 between a position away from opening 15a or closer to opening 15a. The embodiment illustrated in FIGS. 3 and 4 presents additional advantages because electromagnet 10 is eliminated and is replaced by spring 16 thereby omitting the electrical circuit required to energize electromagnet 10.

Figure 6:
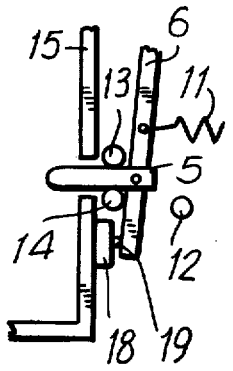
FIG. 6 is a side elevational view of a further embodiment of the invention.

In another embodiment of the invention, a microswitch 18 formed with an ON-OFF button 19, as illustrated in FIG. 6, is mounted on paper roll frame 15 in place of reed switch 9 of the embodiments illustrated in FIGS. 1 and 3. Microswitch 18 is placed in its ON condition when retaining bar 6 is pivoted to its second position towards paper roll 1. Retaining bar 6 impinges button 19 of microswitch 18 to generate a near-end detecting signal.

Figure 5:
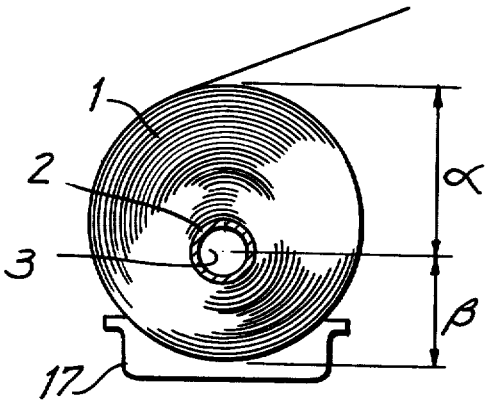
FIG. 5 is a cross-sectional view of a paper roll in a roll retaining and guiding member.

Referring now to FIG. 5, a side elevational view of paper 1 as it is unwound off core 2 is shown. Paper roll 1 is shown mounted on a retaining and guiding member 17. As paper 1 is printed by a printer (not shown) it is wound off gradually and it has a thickness $\gamma$ from the center of core 2 to the upper portion of paper 1 and a thickness $\beta$ from the center of core 2 to the lower portion of paper 1. The relationship between $\gamma$ and $\beta$ is such that $\gamma$ is greater than $\beta$ due to the fact that the upper portion expands due to the resilient force of the paper itself. Thus, thickness $\gamma$ of paper roll 1 deviates depending upon the type of paper used while thickness $\beta$ tends to remain the same. Based on this, it is evident that thickness $\beta$ is more accurate for detecting the near-end condition of paper roll 1. For this reason, the invention utilizes thickness $\beta$ for determining a near-end condition.

Accordingly, by constructing and arranging a paper roll near-end detection assembly in accordance with the invention, it is possible to obtain a highly accurate, outside vibration-resistant and low-priced detecting assembly. The detection assembly has been illustrated and described for use in a printer. However, it is also possible to use a near-end roll detection device constructed and arranged in accordance with the invention for detecting a wide variety of materials unwound from the core, thus providing industrial wide use.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An end of a paper roll detecting assembly for detecting a predetermined amount of paper remaining on a paper roll having a hollow core comprising:

a frame;

paper roll support means for holding said paper roll;

displacing means adapted to be displaced between a first position away from said paper roll and a second position towards said paper roll when the predetermined amount of paper remains on said paper roll;

detecting means mounted on said displacing means including bar means insertable into the hollow core of said paper roll for detecting the predetermined amount of paper remaining on said paper roll; and switch means actuated by displacement of said displacing means to said second position.

2. The assembly of claim 1, wherein said displacing means includes lever means adapted to be displaced between a first position away from said paper roll and a second position towards said paper roll, said bar means mounted on said lever means.

3. The assembly of claim 2, wherein said displacing means further includes means for displacing said lever means towards said second position.

4. The assembly of claim 3, wherein said means for displacing said lever means includes electromagnet means for selectively displacing said lever means towards said second position.

5. The assembly of claim 4, including biasing means for normally biasing said lever means in said first position.

6. The assembly of claim 5, wherein said lever means is an elongated lever and said bar means is a bar insertable into the core of said paper roll.

7. The assembly of claim 6, wherein said switch means is a microswitch actuated by said lever when said lever is displaced to said second position when a predetermined amount of paper remains on said paper roll.

8. The assembly of claim 6, wherein said switch means includes magnet means mounted on said lever and a reed switch actuated by said magnet means when said lever is displaced to said second position.

9. The assembly of claim 3, wherein said means for displacing said lever means is a spring for continually biasing said lever means towards said second position.

10. The assembly of claim 9, wherein said switch means includes magnet means mounted on said lever means, and a reed switch actuated by said magnet means when said lever means is displaced to said second position.

11. The assembly of claim 9, wherein said switch means is a microswitch actuated by said lever means when said lever means is displaced to said second position when a predetermined amount of paper remains on said paper roll.

12. The assembly of claim 1, wherein said frame is formed with an opening for receiving said detecting means, said detecting means passing through said opening into said core of the paper roll when a predetermined amount of paper remains on said roll.

13. The assembly of claim 12, wherein said paper roll support means is adjustably positionable in said frame with respect to the opening in said frame for varying the amount of paper remaining on said roll when said detecting means is inserted into said core.

* * * * *